United States Patent [19]

Dickert, Jr. et al.

[11] 4,257,869

[45] Mar. 24, 1981

[54] LIQUEFACTION OF ACID TREATED COAL

[75] Inventors: Joseph J. Dickert, Jr., Yardley, Pa.; Thomas O. Mitchell, Trenton; Darrell D. Whitehurst, Titusville, both of N.J.

[73] Assignee: Electric Power Research Institute, Palo Alto, Calif.

[21] Appl. No.: 67,426

[22] Filed: Aug. 17, 1979

[51] Int. Cl.[3] ..... C10G 1/00

[52] U.S. Cl. ..... 208/8 LE; 208/10

[58] Field of Search ..... 208/8 R, 8 LE, 10

[56] References Cited

U.S. PATENT DOCUMENTS

| | | | |
|---|---|---|---|
| 363,155 | 4/1943 | Juettner | 208/8 LE |
| 1,280,178 | 10/1918 | Day | 208/8 LE |
| 2,141,615 | 12/1938 | Patt | 208/8 LE |
| 2,221,410 | 11/1940 | Pier | 208/8 LE |
| 3,700,583 | 10/1972 | Salamony et al. | 208/8 LE |
| 3,926,575 | 12/1975 | Meyers | 208/8 LE |
| 4,133,740 | 1/1979 | Paraskos et al. | 208/8 LE |
| 4,148,716 | 4/1979 | Paraskos | 208/8 LE |

*Primary Examiner*—Veronica O'Keefe

*Attorney, Agent, or Firm*—Scully, Scott, Murphy & Presser

[57] ABSTRACT

Preliminary extraction of coal with mineral acid changes the course of coal liquefaction in a solvent under hydrogen pressure. At short reaction periods, yields of high boiling fuel product is enhanced.

14 Claims, No Drawings

LIQUEFACTION OF ACID TREATED COAL

FIELD OF THE INVENTION

The invention concerns improvement in solvent refining of coal whereby components of coal suitable for fuel are extracted from comminuted coal by a solvent and recovered as a low melting point mixture of reduced sulfur and mineral matter content adapted to use as fuel in conventional furnaces. In the type of operation to which the invention is directed, the solvent is derived from the product extract and applied to the raw coal feed.

BACKGROUND OF THE INVENTION

The present emphasis on the conversion of coal to substitute solid and liquid fuels has led to several alternative processes which are now being considered. The end use of the resultant converted coal will primarily determine the degree of conversion that must be accomplished and the quality of the desired product. The optimal use of the coal will depend on the specific application.

Among the many processes presently being considered is the solvent refining of coal (SRC) in which coal is treated at an elevated temperature in the presence of a hydrogen donor solvent and hydrogen gas in order to remove the mineral matter, lower the sulfur content of the coal, and to convert it into a low melting solid which can be solubilized in simple organic solvents. This SRC can also be upgraded through catalytic hydrogenation to produce a liquid of higher quality. Such solvent refining of coal typifies liquefaction processes adapted to improvement by the technique of this invention.

Little is known at present as to the exact mechanisms by which the coal is transformed into soluble form, or of the detailed chemical structure of the soluble product or even the parent coal. It is known that many coals are easily solubilized and for others solubilization is more difficult. Some correlations have been made between the rank of the coal and ease of solubilization and product yield. A somewhat better correlation has been found with the petrography of the coal. Little is known about the relationships to product quality.

The initially dissolved coal (SRC) may have utility as a substitute clean fuel or boiler fuel; however, for substitute fuels of higher quality, specifications on viscosity, melting point, ash, hydrogen, and sulfur contents are much more stringent. Attempts to meet these specifications by operating the SRC process more severely have met with many difficulties such as low liquid yields, high hydrogen consumption, difficulty of separating unreacted residue, and excessive char formation, which often completely plugs process transfer lines and reactors.

Alternative methods of improving specifications through catalytic hydrogenation are also difficult. The problems which arise are threefold: (1) SRC components are susceptible to further condensation and may deposit as coke on catalysts used for their conversion, (2) they can also foul the catalysts by physical blockage as their size approaches the pore size of conventional catalysts, and (3) they may contain metal contaminants, and their highly polar nature (particularly nitrogenous and sulfur compounds) can lead to selective chemisorption, and thus poison the catalysts.

The precise chemical nature of the SRC is still unknown; generally its composition is discussed in terms of solubility. Several classifications are commonly used. These include oils which are hexane or pentane soluble, asphaltenes which are benzene soluble, and pyridine soluble-benzene insoluble materials. Of these the asphaltenes and pyridine soluble-benzene insoluble materials are believed to be responsible for high viscosity, solvent incompatability, and processing difficulties. Little is known about the pyridine soluble-benzene insoluble materials. These have been referred to as "pre-asphaltenes" which implies that asphaltenes are derived from them; however, this has yet to be established.

More information is available on the nature of asphaltenes. It is common experience that coal liquids contain large quantities of materials known as asphaltenes. In fact, it has even been suggested that the formation of asphaltenes is a necessary step in the liquefaction of coal.

The term asphaltene is a rather nebulous and all-inclusive classification of organic materials for which a detailed chemical and physical identification is quite difficult, and has not yet been accomplished.

This classification generally refers to high molecular weight compounds, boiling above 650° F., which are soluble in benzene and insoluble in a light paraffinic hydrocarbon (e.g., pentane). Usually no distinction is made regarding polarity, as the term has been used customarily in the characterization of heavy petroleum fractions (resids, etc.) where the amount of highly polar materials is small. However, in coal liquids this may not necessarily be the case due to the high degree of functionality of coal itself. Thus, coal liquids of low molecular weight may still be "asphaltenes". There is considerable variation in the molecular weight of solubilized coals which arises from differences in the parent coals, or different solvents or solvent-reactant systems at the same temperature of reaction. This could well be related to colloidal properties of coal liquids. It is well documented that asphaltenes found in heavy petroleum fractions are colloidal in nature.

Some comments on the chemical nature of coal asphaltenes have recently been made. Asphaltenes from Synthoil Process liquids were separated into a basic fraction (containing oxygen only as ether or ring oxygen and basic nitrogen as in pyridine) and an acidic fraction (containing phenolic OH and nitrogen as in pyrrole). The two fractions were found to have very different properties. The basic fraction could be hydrotreated only with difficulty, while the acid fraction underwent facile hydrotreating. This is consistent with reported data on the influence of nitrogen heterocycles on conventional hydroprocessing.

Based on these results in acid-base pair structure for asphaltenes was proposed and this structure was extrapolated to that of coal itself. This structure is quite different from the more amphoteric nature of coal which has been proposed previously.

Mechanisms have been proposed for the noncatalyzed formation of asphaltenes from coal. In this work it was concluded that asphaltenes were a necessary product of coal liquefaction and that oils were derived from asphaltenes. The more polar pyridine soluble materials were not investigated and were assumed to be equivalent to unreacted coal. The maximum yield of asphaltenes was found, however, to be a function of the conditions of coal conversion; hydrogen donor solvents greatly reduced the propensity for formation of asphaltenes at low conversion. In addition, it was not determined whether the asphaltene fractions resulting from different conditions were of the same chemical and/or physical nature. Thus, asphaltenes may be inherent constituents of coal products or they could well be the result of either thermal or catalytic transformations of more polar materials.

In considering what may be involved in the formation of asphaltenes during coal solubilization or conversion, it may be instructive to consider what is known of coal structure. Coal is a rather complicated network of polymeric organic species, the bulk of which is porous in the natural form; the pore system varies from coal to coal. Depending upon the specific nature of the porous structure of each coal, its chemical constituents, and the reaction conditions, the rate of diffusion and mass transport of organic molecules through the pores could have a strong effect on the rates of dissolution, hydrogen transfer, and hydrogenation and hydrocracking reactions, and thus on the ultimate yield of soluble product.

As the rank of coal becomes higher, an increasing number of colloidal size aggregates (20–50 Å) can be observed by X-ray scattering and diffraction.

If, in the early stages of the dissolution of coal these colloidal aggregates dissociate to some degree and go into solution, the molecular weight of the lowest unit appears to be consistent with the lowest molecular weights observed in solubilized coals (~500 MW). This comparison may be coincidental, however. Unfortunately, in order to dissolve coal it is generally found that temperatures in excess of 300° C. are necessary. It is also known that coal begins to pyrolize and evolve volatile matter at temperatures as low as 250° C. (depending on rank), and by 350° C. considerable material has evolved. This strongly suggests that extensive internal rearrangement of the coal occurs during the dissolution process. Rearrangement can include hydrogen migration to produce highly condensed aromatic rings as well as further association of small colloidal aggregates or condensation of reactive species. Major physical changes in the pore system of the solid coal have also been reported.

This rearrangement could possibly be responsible for some of the very high molecular weights (~3000 MW) observed with some solvents. No detailed relationships of solvent type and/or reaction condition to the molecular weight distribution of solubilized coal has yet been established. Similarly, the possibility of reversible molecular weight changes, due to recondensation causing increased molecular weights at various temperatures, has not been investigated thoroughly.

An alternative route to high molecular weight is through the catalytic influence of inorganic coal minerals which are present in the processing of coal. It is known that some coals are more reactive than others, producing higher yields of liquid products at shorter residence times. It is believed that this is due to the fact that the initial coal products are reactive and condense to char unless proper reaction conditions are established. This further condensation could well be a catalytic phenomenon induced by intrinsic coal minerals.

Another more subtle consequence of certain inorganic constituents is their influence on the physical properties of pyrolytic coal chars, and thus on the diffusional properties imposed on reactive intermediates. The volume of char has been observed to vary by a factor of four or more, with little change in weight, by varying the type of inorganic contaminants in a given bituminous coking coal. The pore system of the resultant chars must be vastly different and changes of this type magnitude in the physical structure of the coal or char could greatly influence mass transport of intermediates produced within the pore system. Mass transfer limitation during the pyrolysis and hydrogasification of some coals at high temperatures has recently been established. This study showed that for some coals, reactive primary products are formed which can recombine to produce char if the conditions are not properly adjusted. The criticality was found to be the rate of diffusion of the reactive species out of the coal relative to its rate of conversion to char.

At lower temperatures, the rates of reaction are, of course, slower and thus less susceptible to mass transport limitations. However, the imposition of a liquid phase, commonly used in liquefaction processes, may greatly enhance diffusional restrictions. Recent model studies conducted in aqueous systems, have shown that restriction of diffusion through porous structures with pore radii ranging from 45 Å to 300 Å for even relatively small solute molecules is very significant.

At the present stage of the art, the accumulated information is largely empirical, with little basis for sound extrapolation to predict detailed nature of solvent and processing conditions for optimum yield and quality of solvent refined coal. It is recognized that the poorly understood asphaltenes are probable sources of many of the problems encountered, e.g. formation of char at processing conditions conducive to efficient separation of mineral matter (ash) and sulfur from desired product at high yield.

In the process of converting coal to a low sulfur, low melting solid by use of recycled product fractions as solvent, several reaction steps occur. Generally coal is admixed with a suitable solvent recycle stream and hydrogen and the slurry is passed through a preheater to raise the reactants to a desired reaction temperature. For bituminous coal, the coal is substantially dissolved by the time it exits the preheater. Sub-bituminous coals can be dissolved but care must be exercised not to raise the temperature too high and thus promote charring.

The products exiting from the preheater are then transferred to a larger backmixed reactor where further conversion takes place to lower the heteroatom content of the dissolved coal to specification sulfur content and melting point. The geometry of this reactor is such that the linear flow rate through it is not sufficient to discharge a substantial quantity of particulate matter of a desired size. Thus the reactor volume becomes filled (at steady state) up to about 40 vol % by solids which are produced from the coal. These solids have been shown to be catalytic for the removal of heteroatoms and the introduction of hydrogen into the coal products and solvent. The products exiting the reactor are initially separated by flash distillation, which depressurizes the stream and removes gases and light organic liquids. The products are further separated (filtration, centrifugation, solvent precipitation, etc.) and the filtrate is distilled to recover solvent range material (for recycle) and the final product SRC.

It has been demonstrated that the inorganic mineral content of coal may be extracted in large measure by leaching with hydrochloric and hydrofluoric acids as a step in the analysis described by Bishop and Ward "The Direct Determination of Mineral Matter in Coal", FUEL, 37, 191–200 (1958). The authors show that pyritic iron content of a coal is substantially unaffected by the acid treatment. Analysis for inorganic mineral content of coal is based in part on analysis of ash from the extracted coal and conversion of the iron value to pyritic iron equivalent. See also Radmacher and Mohrhauer, Brennstoff-Chemie, 37, p26 (1956).

SUMMARY OF THE INVENTION

The Bishop and Ward method of acid extraction from coal for analytical purposes is applied in preparation of coal for liquefaction in recycle solvent. Although such liquefaction is normally carried out under hydrogen pressure, it is within the scope of this invention to conduct the liquefaction in the absence of hydrogen gas. The pyritic iron remaining after leach with acid provides adequate catalysis for the dissolution stage and other inorganic constituents of the coal which can be a disadvantage in dissolution or in downstream catalysis are removed in large measure. Although studies of the acid extracted coal indicate there has been no significant change in the chemical or physical character of the coal structure (other than removal of calcium and other exchangeable cations) many coals are found to be more reactive after acid extraction as evidenced by shorter reaction times or better yields or both. A particularly advantageous feature is increased yield of solvent refined coal at short dissolution contact time, e.g. about 3 minutes. Increased yields of recycle solvent have been found at long contact times.

DESCRIPTION OF PREFERRED EMBODIMENTS

The method of this invention may be applied to any of the coal dissolution techniques carried out at elevated temperatures in the presence of solids derived from dissolution and in the presence of recycle solvent also derived from coal dissolution. The process generally referred to as "SRC" (for Solvent Refined Coal) is typical and will be referred to herein for illustrative purposes. The nature of the SRC process and some of the theoretical aspects of the process as presently understood are outlined above. Briefly stated, the SRC process involves mixing cleaned and crushed coal with a "recycle solvent" derived in the process which contains phenols, heterocyclics and polycyclic aromatics (or their hydrogenated derivatives). The resultant slurry is heated and passed to a back-mixed reactor in which solids from the coal are accumulated. It is believed that coal is dissolved and undergoes depolymerization to yield reactive fragments which can polymerize to solid char, a reaction which is inhibited by satisfaction of reactive fragments with hydrogen from the hydrogen donors in the solution constituted by hydrogenated polycyclic aromatics. The solubility of these fragments is improved by solvent components such as phenols and/or polyaromatics.

In the presence of catalytic mineral solids derived from the coal, the hydrogen donors are believed to be regenerated to continue their function in the reactor.

Whatever may be the mechanisms of the reactions which provide for successful conduct of the SRC process, it is known that char is increased if the coal is dissolved and reacted in the absence of hydrogen donors or hydrogen and coal derived solids or an extraneously introduced hydrogenation catalyst. In the present state of the art, it is appropriate to consider the present improvement in the light of the presently accepted theory, subject to revision of theoretical background as more knowledge of mechanisms becomes available.

According to this invention, operation of processes such as SRC is improved by a coal preparation step of acid leach to remove a portion of the inorganic mineral content of the coal which would otherwise become part of the solids retained in the backmixed reactor. This selective removal of mineral matter is found to result in retention of catalytic activity of the reactor solids and to alter reactivity of the coal in a manner to permit shorter contact time or greater conversion of the coal. There is some evidence in the literature to support the proposition that removal of calcium may convert a non-swelling coal to a swelling coal or to enhance the swelling characteristics. The laboratory scale experiments reported below were conducted under mild conditions in order that the chemical nature of the coal should remain unaltered. Intensive examination of the acid extracted coals by several sophisticated techniques support the conclusion that no alteration occurred with respect to the organic components. It is believed that observed changes in reactivity of the coal are attributable, at least in large part, to physical change, perhaps by enhancing swelling characteristics, thus rendering the coal more readily accessible by the solvent. It seems likely that such metals as sodium are removed in part by base exchange of carboxylic acid salts or ion exchangeable clays to replace metal by protonic cations.

Benefits of the invention are obtained by treating the coal only with hydrochloric acid, which removes calcium, sodium and certain other elements to a major extent, leaving pyritic iron and, probably, acid clay. Iron in other forms such as ferric compounds and exchangeable iron is believed to be extracted. In any event, the solids which remain undissolved in recycle solvent exhibit the properties needed for successful processing in operations similar to SRC. The invention also contemplates a first HCl extraction followed by extraction with HF. Preferably, such sequence is concluded by a final HCl extraction. It is generally undesirable to use HF as a first extraction, whether or not followed by extraction with HCl. Any calcium present will be converted by HF to insoluble calcium fluoride.

Each acid extraction is conducted by immersing crushed coal in at least enough acid to fill the voids at temperatures up to the boiling point of the acid at the pressure on the system. No clearly defined advantage is known for imposing a pressure on the extraction apparatus except for the usual increase in rate of chemical reactions with increase in temperature. The temperature of reaction will generally be between 0° F. and 300° F. Acid strengths between about 1% and 30% by weight of acid in water will be found suitable for extraction times of 10 minutes to 15 hours or more. It will be apparent that acid strength, time and temperature are interdependent variables such that any one may be increased to compensate for decrease of another.

After each stage of acid extraction, the coal is washed with water to remove the soluble compounds resulting from the acid treatment. The type of apparatus employed and the manner of contacting are not seen as critical. The extraction may be carried out in a tank or other suitable vessel. An alternative which may be attractive under certain circumstances involving transport of coal from a mine to the SRC plant is to slurry crushed coal in dilute acid and transport the slurry by pipeline while the extraction operation is carried out.

The degree of demineralization may be varied to suit preferences based on the dissolution system to be employed, end use of the product or other considerations.

For example, in preparing feed coal for an SRC plant operated to produce boiler fuel which is solid at ambient temperature, it may be desirable to demineralize as fully as possible by extraction with HCl, followed by HF, with a final HCl extraction. Following such extraction, maximum SRC product is obtained at short contact time in the SRC reactor, say about 5 minutes or less. Usually, cumulative conversion rises over the first 5 minutes of SRC contact time and then remains nearly constant during a contact period of 5 to 20 minutes. At longer contact times, yields of recycle solvent increase, accompanied by decreased yield of SRC.

Following acid extraction, the coal is slurried in recycle solvent, heated to the desired reaction temperature above about 700° F. and charged to the backmixed reactor together with gaseous hydrogen. Temperatures in the reactor will be in the range of 700°–900° F. at 500 to 3,000 psig. Following start-up, solids resulting from dissolution will be retained in the reactor until the volume of solids is about equal to 40% of the reactor volume. It is feasible to start up the system on raw coal which has not been acid extracted and begin acid extraction only after the desired volume of solids has been accumulated. Thereafter the reactor will be brought to steady-state condition on acid extracted coal. Such steady-state operation conforms to usual practice in the art except for the preferred operation to make a large proportion of SRC at short contact time; less than 20 minutes, preferably 5 minutes or less, say in the range of 1 to 5 minutes.

Improvements in yield by use of the present invention appears to have some relationship to nature of the untreated coal. When acid extraction is applied to coals which are highly reactive in the raw state, yield changes after acid extraction, if any, tend to be of small magnitude. In such cases, the improvements attributable to the invention may be primarily in elimination or reduction of inorganic materials to be handled downstream of the reactor.

In the examples below, descriptions are provided on autoclave runs for reacting raw and demineralized coals with recycle solvent under hydrogen pressure. The technique for demineralization is described in the following paragraph:

Coal Demineralization

For each coal, 35 g (ground to <45 micron) was mixed with a solution of 50 ml of 37.7% HCl in water and about 50 ml more water under a nitrogen atmosphere. The mixture was stirred with a magnetic stirrer at room temperature for about 3½ hours, then filtered through a Millipore filter. The solid product was washed twice on the filter, each time with about 100 ml of water, then transferred to a polypropylene vessel. About 50 ml water and 100 ml 49% HF solution were added and the mixture was stirred with a magnetic stirrer, again under nitrogen, for about 4½ hours. The mixture was allowed to settle, and the clear solution was aspirated off the top. The product was washed by adding 200 ml of water, the mixture was stirred and allowed to settle, and the clear solution was aspirated off the top. This water wash was repeated, 200 ml more water was added, and the mixture was stirred well. The product coal was recovered by filtration through paper supported on a polypropylene Buchner funnel, and then washed two times on the filter, each time with about 100 ml water. The solid was transferred to a glass vessel with about 50 ml of water, and 50 ml of 37.7% HCl was added. The mixture was stirred under nitrogen with a magnetic stirrer for about 3 hours. The product was recovered on a Millipore filter, transferred back to a flask and slurried with about 150 ml water, then filtered and washed on the filter with about 200 ml of water. The solid was returned to a flask and the last washing, filtration, and washing were repeated. The recovered product was dried in argon at about 0.2 atm. in an oven at 260° F.

It will be noted that the foregoing acid extraction at room temperature is milder than the Bishop and Ward analytical procedure involving acid treatment at 55°–60° C. (upwards of 130° F.) for a shorter period of time. The exemplary method here is laboratory technique designed to avoid chemical change of the organic constituents. The invention however, contemplates acid leaching at more severe conditions of temperature and acid concentration to reduce the time required. The demineralization described involves treatment with HCl, HF and HCl in succession (sometimes abbreviated below "HCl, HF, HCl"). Extraction with HCl alone followed the same procedure with deletion of the HF contact step.

In like fashion, the examples below of solvent refining of raw and treated coals are reports of laboratory techniques to provide comparable data. Thus the solvent is a mixture of polycyclic hydrocarbons, phenols and heterocyclic organic compounds having the boiling range, distribution of chemical types, coal solvent power and hydrogen donor activity typical of the average recycle solvent. The processing experiments were conducted by introducing solvent and crushed coal to a heat jacketed stirred autoclave normally under hydrogen pressure. The autoclave is equipped with a sampling device capable of removing a sample during the term of an experimental run in order to evaluate the effect of time on the course of the reaction.

EXAMPLE 1

Wyodak coal was exhaustively treated with HCl, then HF, again with HCl by the procedure described above. Exhaustive extraction with pyridine in a Soxhlet extractor of the demineralized Wyodak coal yielded 15% soluble products as compared to about 12% for the untreated coal. That result is evidence that demineralization did not grossly alter the organic portion of the original coal. Fourier Transform Infrared Spectroscopy also showed little change in the organic constituents (by comparison of untreated and demineralized Wyodak coal).

EXAMPLE 2

Burning Star coal was also exhaustively extracted by HCl, HF, HCl treatment.

EXAMPLE 3

That exhaustive extraction by HCl, HF, HCl was also conducted on Monterey coal.

The inorganic mineral matter in the treated and untreated coals of Examples 1, 2 and 3 was examined by ashing and subsequent emmission spectrographic analysis. The results are given in Table 1. Iron was the only metal present in major amounts (>10% of ash) in all the treated and untreated samples; silicon (in Burning Star and Monterey) and aluminum (in Burning Star) were the elements most affected by the treatment. Among exchangeable cations initially present in larger relative amounts, potassium was significantly removed from the Monterey and calcium from the Wyodak; neither was changed as much in the other coals. Sodium was generally less affected. The other elements, present in lesser amount, appear to be approximately uniformly affected by the acid treatments, as their relative concentrations remain the same. The absolute amounts of ash of course were greatly reduced.

Table 2 gives the ultimate and sulfur type analyses of these samples. The acid treatment did not appreciably change the H/C ratios, nor did it appear to have removed pyritic sulfur. However, the ash content of the treated coals was lower than expected for the iron oxide from the iron that should be associated with the pyritic sulfur. This discrepancy is not understood, but it certainly indicates that virtually all other mineral matter was removed. Note that sulfate was removed.

TABLE 1

MINERAL MATTER ANALYSES OF TREATED AND UNTREATED COALS

| Examples | Coal | Treatment | % Ash | Elements Detected in Ash[a] | | | | | | | | | | | | | |
|---|---|---|---|---|---|---|---|---|---|---|---|---|---|---|---|---|---|
| | | | | Fo | Ca | Na | Al | Mq | Si | Pb | Cr | Ba | Sr | P | Ni | K | Sn |
| | Burning Star | As received | 14.9 | 1 | 2+ | 3 | 1 | 3 | 1 | 4 | 4 | 4 | 4 | — | 4 | 3+ | 4 |
| 2 | Burning Star | HCl-HF-HCl | 2.16 | 1 | 4 | 4 | 3+ | 3 | 3 | 4 | 4 | 4 | 4 | — | 4 | 4 | — |
| | Wyodak | As received | 7.26 | 1 | 2+ | 2 | 2 | 2 | 2 | 3 | 3 | 3 | 3 | 3 | — | 4+ | 4 |
| 1 | Wyodak | HCl-HF-HCl | 0.44 | 1 | 2+ | 2 | 2 | 3+ | 3 | 3 | 3 | 4 | 4 | — | 3 | 3 | 4 |
| | Monterey | As received | 18.2 | 1 | 2+ | 2 | 2+ | 3+ | 1 | 3 | 4+ | 4 | 4 | — | 4 | 2 | 4 |
| 3 | Monterey | HCl-HF-HCl | 1.46 | 1 | 2+ | 2 | 2 | 3+ | 3 | 4 | 3 | 4 | 4 | — | 3 | 3 | 4 |

| Examples | Coal | Treatment | % Ash | Elements Detected in Ash [a] | | | | | | |
|---|---|---|---|---|---|---|---|---|---|---|
| | | | | Cu | Ti | Zn | Mn | Zr | V | Aq |
| | Burning Star | As received | 14.9 | 4 | 3 | — | 4 | — | — | 5 |
| 2 | Burning Star | HCl-HF-HCl | 2.16 | 4 | 3+ | — | 4 | 4 | — | 5 |
| | Wyodak | As received | 7.26 | 4 | 4 | — | 4 | 4 | 5 | — |
| 1 | Wyodak | HCl-HF-HCl | 0.44 | 4 | 3+ | 4 | 4 | 4+ | 5 | — |
| | Monterey | As Received | 18.2 | 4 | 3 | 4 | 4 | 4 | 5 | — |
| 3 | Monterey | HCl-HF-HCl | 1.46 | 4 | 3+ | 4 | 4 | 4+ | 5 | — |

(a)

| | Approx. Range |
|---|---|
| 1 = Major constituent | over 10% |
| 2 = Minor constituent | 1-10% |
| 3 = Trace constituent | 0.1-1% |
| 4 = Very small trace constituent | 0.01-0.1% |
| 5 = Least detectable trace constituent | less than 0.01% |

TABLE 2

ELEMENTAL ANALYSES OF COALS BEFORE AND AFTER DEMINERALIZATION (<45μ Samples) (Dry Basis)

| | Wyodak | | Monterey | | Burning Star | |
|---|---|---|---|---|---|---|
| | Before | After | Before | After | Before | After |
| Wt % | | | | | | |
| C | 68.80 | 70.20 | 58.95 | 74.69 | 65.98 | 77.04 |
| H | 4.99 | 5.22 | 4.03 | 4.73 | 4.61 | 5.18 |
| H/C (Atomic) | .864 | .887 | .815 | .754 | .832 | .802 |
| O | 16.61 | 22.28 | 13.29 | 15.12 | 9.36 | 10.33 |
| N | .90 | .98 | .92 | 1.26 | 1.14 | 1.22 |
| S (Total) | .62 | .66 | 4.44 | 3.65 | 3.48 | 3.44 |
| Ash | 8.07 | .35 | 18.37 | .49 | 15.40 | 2.02 |
| Cl | .01 | — | — | — | .03 | .77 |
| Sulfur Wt % | | | | | | |
| Sulfate | .06 | | 1.32 | | .53 | .02 |
| Pyritic | .04 | | .72 | | 1.20 | 1.34 |
| Organic | .52 | | 2.40 | | 1.75 | 2.08 |

The mineral matter depleted Wyodak coal was converted under conditions reported in Table 3 and compared to a similar run with untreated coal. Samples removed during the run on demineralized Wyodak were examined by microdistillation technique. With this method, the SRC in solution in the autoclave is determined by distillation of a sample removed from the autoclave through a filter. Samples removed during the run on untreated coal were examined by the gel permeation chromatographic method of SRC isolation. Run conditions and results at termination are shown in Table 3. Conversion is reported on a moisture and ash free basis (MAF). The SRC yields vs. time are shown in Table 4.

TABLE 3

RUN BALANCES FOR DEMINERALIZED WYODAK

| | | |
|---|---|---|
| Coal | Wyodak | Wyodak |
| Particle Size (μ) | <600 | <45 |
| Solvent | Synth | Synth |
| Treatment | | Deminrl |
| Fraction | | |
| Temperature, °F. | 800.00 | 800.00 |
| Pressure, Psig $H_2$ | 1072.00 | 1300.00 |
| Duration (Feed), Min. | 137.50 | 137.50 |
| MAF Conversion, Wt. % | 91.52 | 80.98 |
| Solvent/Coal | 6.17 | 7.67 |
| $H_2S$ | | .15 |
| Water | 4.59 | 4.37 |
| CO | 1.28 | 1.82 |
| $CO_2$ | 6.04 | 7.43 |
| $C_1$ | 2.50 | 3.72 |
| $C_2$-$C_5$ | 4.53 | 5.32 |
| ($C_6$-257° F.) | .14 | .44 |
| (257-650° F.) | 2.38 | 10.86 |
| SRC | 70.03 | 46.79 |
| MAF Residue | 8.48 | 19.02 |
| Balance | 100.00 | 99.93 |
| Ash in Residue | 37.21 | 5.95 |
| Duration (Solv), Min. | 149.50 | 197.50 |
| 4-Picoline | 1.28 | 1.60 |
| p-Cresol | 13.07 | 18.36 |
| Methylindane | 2.59 | 2.81 |
| Tetralin | 25.22 | 24.90 |
| Naphthalene | 18.13 | 14.01 |
| Methyltetralin | 2.37 | 2.32 |
| 2-Methylnaphthalene | 37.36 | 36.01 |
| $H_2$ Consumption | 2.58 | 2.21 |

TABLE 4

SRC YIELD VS. TIME FOR DEMINERALIZED AND UNTREATED WYODAK

| TREATMENT | SAMPLE | REACTION TIME MIN. | WT. % SRC YIELD GPC | MICRO-DIST | RUN BALANCE |
|---|---|---|---|---|---|
| None (a) | 1 | 3.6 | 21.5 | — | — |
| | 2 | 74 | 71.2 | — | — |
| | 3 | 137.5 | — | — | 70.0 |
| None (b) | 1 | 1.3 | — | — | 38.5 |
| Demin. | 1 | 3 | — | 68.5 | — |
| | 2 | 90 | — | 47.4 | — |
| | 3 | 135 | — | — | 46.8 |

In considering the values reported in Table 4, it must be recalled that intermediate reaction time yields are based on samples withdrawn during the course of a reaction and may not be the exact same numbers as would result from terminating the reaction and calculating yields on a material balance. The filter on the sampling device may retain some types of reactor contents. However, the values reported for intermediate samples with untreated and demineralized coal may be validly compared with each other to demonstrate high SRC yield at short reaction time with demineralized coal. Untreated coal (A) and demineralized coal in Table 4 are from the runs reported in Table 3. Untreated coal B is reported on the basis of material balance calculations after a short term run.

In Table 3, SRC and residue are reported separately as fractions of reaction product boiling above 650° F. The portion soluble in pyridine is reported as SRC. The balance is designated as residue.

From the complete balances at the ends of the runs as given in Table 3, it can be seen that the mineral matter depleted coal gave a high yield of residue that was of course almost entirely organic.

In addition to the high residue found in demineralized coal, a number of other significant differences are noteworthy. The mineral matter free Wyodak coal produced higher SRC yields at short times but ultimately less at long times. It also produced more solvent range products boiling below 650° F. and an SRC that contained more oils and a lower oxygen content. All of these phenomena point to an increase in reactivity of Wyodak coal and its liquefaction products in the absence of the coal mineral matter.

The higher rate of dissolution may be a reasonable consequence of demineralization if swelling is an important factor. In the earliest stages of coal dissolution a shell-progressive mechanism may be operative at the external surface as well as the internal surface of the largest pores. Wyodak coal differs from the bituminous coals investigated in that it is non-swelling. It is known that a highly swelling coal can be converted to a non-swelling coal by inclusion of as little as 5% of basic oxide. Perhaps by removal of basic oxides swelling has been promoted in the present case.

It is also possible that the mineral matter in Wyodak coal, which is quite different from that in some other coals (as for instance in its high calcium content) retards reactions. When it is removed a possibly higher innate reactivity of the organic portion of this coal is revealed or the non-extracted minerals are activated by acid.

These theoretical conclusions are based on limited data for demineralized coal and may be subject to revision as more becomes known on this process. Regardless of what mechanism is involved, the data clearly demonstrate improved SRC yields at short reaction time with the demineralized coal.

EXAMPLE 4

An autoclave run was conducted with Wyodak coal that had been treated with HCl only. Such a treatment would partially demineralize the coal, removing carbonates and similar salts and leaving behind pyrites and the acid forms of clays. The partial demineralization procedure, given below, is essentially the same as the HCl portion of the HCl—HF—HCl treatment described above.

150 g of Wyodak coal (ground to less than 45 micron size) was mixed with a solution of 225 ml of HCl (36.5–38.0% in water) and about 225 ml more water under a nitrogen atmosphere. The mixture was stirred with a magnetic stirrer at room temperature for about 3½ hours, then filtered through a Millipore filter. The solid product was washed on the filter with about 250 ml of water, then returned to a glass vessel with about 225 ml of water, and 225 ml of the concentrated HCl was added. The mixture was stirred under nitrogen at room temperature with a magnetic stirrer for about 3½ hours. The product was recovered on a Millipore filter and washed on the filter with about 250 ml water. It was then transferred back to a flask and slurried with about 500 ml water, then filtered. The recovered product was dried in argon at about 0.2 atm. in an oven at about 230° F.

The data for an autoclave run are presented in Table 5. For comparison to the large 3.5 minute sample withdrawn in this run, which gave a 63% yield of SRC by conventional vacuum distillation, a sample withdrawn at 3.6 minutes in the run above with untreated Wyodak gave 21.5% SRC by gel permeation chromatography and a sample withdrawn at 3 minutes on HCl, HF, HCl treated coal above gave 68.5% SRC by vacuum microdistillation. See also the 1.3 minute run above with untreated coal and conventional work-up where the SRC yield was 39%.

From the data it can be seen that the run with HCl treated coal was most like the run with HCl—HF—HCl treated coal. The product distributions and elemental analyses at the ends of the runs were very similar. The principle difference was that in the run of Table 5 there was more gas and light liquid made, more hydrogen consumption from gas and less solvent range material. Conversions, SRC yields, hydrogen consumption from solvent and oxygen conversions were virtually identical. The high balance in Table 5 is probably due to difficulties in properly assessing gas yields in this complicated run and perhaps also to a higher gas make from solvent. It does not appear to be due to synthetic solvent inclusion in the SRC, as judged from the solvent analysis. If anything, the coal and its products were even more reactive than in Table 3, except that there was no increase in regression. Both were more reactive than was untreated coal.

The results at short times are also interesting. As with HCl, HF, HCl treat, the SRC yield at about 3 minutes was higher than for the untreated coal. Furthermore, and somewhat surprisingly, the SRC at 3.5 minutes in Table 5 showed less indication of defunctionalization than did that from untreated coal at only 1.3 minutes. The oxygen content in the 3.5 minute sample was higher and the hydrogen content lower than with untreated coal.

TABLE 5

| AUTOCLAVE RUN WITH HCl TREATED WYODAK COAL | | |
|---|---|---|
| Temperature, °F. | 800 | 800 |
| Pressure, psig $H_2$ | 1200 | 892 |
| Duration | 3.5 | 135.8 |
| Diluent/Coal | 6.24 | 5.81 |
| % Conversion, wt. MAF | 70.00 | 78.14 |
| Water | | 3.16 |
| CO | | 3.04 |
| $CO_2$ | | 13.60 |
| $C_1$ | | 6.71 |
| $C_2$-$C_5$ | | 12.44 |
| $C_6$-257° F. | 1.50 | 3.04 |
| 257-650° F. | 0.40 | 1.70 |
| SRC | 63.00 | 44.62 |
| MAF Residue | | 21.73 |
| Balance | | 112.00 |
| Ash in residue | | 16.46 |

Table 6 presents a summary of results from short term autoclave runs on untreated coal shown for comparison with the two types of acid treatment, namely HCl alone and HCl, HF, HCl.

TABLE 6

| Coal Treatment | Time (min) | Wt % SRC Yield | Wt % 0 in SRC | H/C in SRC |
|---|---|---|---|---|
| none | 1.3 | 38.5 | 11.75 | 0.99 |
| none | 3.6 | 21.5 | — | — |
| HCl | 3.5 | 63 | 14.38 | 0.83 |
| HCl/HF/HCl | 3 | 68.5 | — | — |

With HCl treatment, at short times the increased re-activity led to greater SRC production with little change in composition; at longer times the increased reactivity led to greater SRC (and/or solvent) loss, making gas and insoluble residue. Increased solvent production, observed with HCl, HF, HCl treatment is not completely understood. A possible explanation is that the HCl treatment makes the coal very reactive (or the mineral matter a better catalyst); subsequently HF treatment somewhat reduces this activity so that solvent is made instead of gas.

EXAMPLE 5

Burning Star coal from Illinois was treated successively with HCl, HF, HCl by the procedure described for Wyodak coal above and converted in a run like Example 4. The results are presented in Table 7 (Balances) and Table 8 (Elemental Analyses).

A large sample was withdrawn at 3 minutes. It can be seen that at 3 minutes the conversion of the demineralized Burning Star coal appeared to be lower than might have been expected. All product yields at 3 minutes were directly determined except for the residue which was assumed in order to force the balance to 100%. The conversion is, therefore, approximate. The SRC yield was about as expected and gases and liquids may be slightly higher. This is in contrast to the results with Wyodak, where this treatment greatly increased the SRC yield at short times. The difference may be due to the normally lower reactivity of untreated Wyodak coal relative to untreated Burning Star coal, i.e., there was little room for an increase in the Burning Star SRC yield.

At longer times, the treated Burning Star coal showed a lower apparent conversion, slightly lower SRC yield, much lower solvent yield, greater hydrogen consumption, and higher gas production than what was predicted. These results again are consistent with increased reactivity of the coal and/or its products or increased activity of the mineral matter. The results are comparable to those with HCl treated Wyodak. The increase in reaction appears to have been too much, resulting in increased gas production at the expense primarily of solvent and light liquid. This is consistent with the high hydrogen consumption.

TABLE 7

| AUTOCLAVE RUN ON DEMINERALIZED BURNING STAR COAL | | |
|---|---|---|
| Temp., °F. | 805 | 800 |
| Pressure, psig $H_2$ | 710 | 480 |
| Solvent/Coal | 5.86 | 5.06 |
| Duration (min.) | 3.00 | 137.00 |
| MAF Conversion, Wt. % | 81.00 | 81.10 |
| $H_25$ | 3.30 | 0.96 |
| Water | 0.20 | 1.01 |
| CO | 1.30 | 0.98 |
| $CO_2$ | 3.50 | 2.24 |
| Cl | 1.70 | 5.17 |
| $C_2$-$C_3$ | 2.60 | 6.09 |
| $C_6$ - 257° F. | | 2.06 |
| 257-650° F. | 3.00 | 0.48 |
| SRC | 85.40 | 64.54 |
| MAF Residue | 19.00 | 18.86 |
| Balance | 100.00 | 102.40 |
| Ash in Residue | | 10.00 |

TABLE 8

ELEMENTAL ANALYSES OF SAMPLES (Example 5)

| Sample | Raw Coal | Demineralized Coal | SRC |
|---|---|---|---|
| Wt. % | | | |
| C | 65.98 | 77.04 | 86.42 |
| H | 4.61 | 5.18 | 6.27 |
| O | 9.36 | 10.33 | 4.34 |
| N | 1.14 | 1.22 | 2.05 |
| S | 3.48 | 3.44 | .84 |
| Ash | 15.4 | 2.02 | .02 |
| Cl | 0.03 | 0.77 | |
| H/C | 0.84 | 0.81 | .87 |
| K BTU/lb | | | 16.09 |
| Sulfur Types | | | |
| Sulfate | 0.53 | 0.02 | |
| Pyritic | 1.20 | 1.34 | |
| Organic | 1.75 | 2.08 | |

We claim:

1. A process for liquefaction of coal by reaction of crushed coal in an aromatic recycle solvent derived in the process, the improvement which comprises extracting inorganic mineral constituents from the coal by contact with aqueous hydrochloric acid and reacting the demineralized coal in an aromatic solvent for a reaction period of not substantially more than about five minutes at an elevated temperature of about 700° F. to 900° F.

2. A process according to claim 1 wherein the coal is a sub-bituminous coal.

3. A process according to claim 1 wherein the coal is a bituminous coal.

4. A process according to claim 1 wherein the coal is further contacted with hydrofluoric acid after the said contact with hydrochloric acid and before the said reaction in solvent.

5. A process for liquefaction of coal by reaction of crushed coal in an aromatic recycle solvent derived in the process, the improvement which comprises pretreating said coal by extraction of inorganic mineral matter therefrom by contacting the crushed coal with aqueous hydrochloric acid for a period of time sufficient to render at least a portion of said mineral matter soluble in water, washing the coal with water to remove soluble material therefrom and thereafter reacting the extracted coal in a solvent at a temperature of about 700° F. to 900° F.

6. A process according to claim 5 wherein said coal is of the sub-bituminous type.

7. A process according to claim 5 wherein said coal is of the bituminous type.

8. A process according to claim 5 wherein said coal is further contacted with hydrofluoric acid after the said contact with hydrochloric acid and before the said reaction in a solvent.

9. A process according to claim 1 wherein said coal is reacted in an aromatic solvent under hydrogen pressure.

10. A process according to claim 5 wherein said coal is reacted in a solvent under hydrogen pressure.

11. In a process for liquefaction of coal which contains pyritic iron in an aromatic solvent derived in the process by mixing crushed coal with said solvent and reacting the mixture under hydrogen pressure at a temperature of about 700° to 900° F., separating an aromatic liquid fraction from the reaction product and recycling said aromatic liquid fraction to said mixing step as the said aromatic solvent derived in the process; the improvement which comprises pretreating said coal to extract inorganic mineral matter therefrom by contacting the crushed coal with aqueous hydrochloric acid for a period of time sufficient to render at least a portion of said inorganic mineral matter soluble in water, washing the coal to remove soluble material therefrom and thereafter reacting the extracted coal as aforesaid, whereby pyritic iron is retained by the extracted coal to act as a catalyst during said step of reacting said coal admixed with said solvent while other inorganic mineral matter from said coal is extracted from the coal.

12. A process according to claim 11 wherein said coal is of the sub-bituminous type.

13. A process according to claim 11 wherein said coal is of the bituminous type.

14. A process according to claim 11 wherein said coal is further contacted with hydrofluoric acid after the said contact with hydrochloric acid and before the said reaction in a solvent.

* * * * *